US009643426B2

(12) United States Patent
Sato et al.

(10) Patent No.: US 9,643,426 B2
(45) Date of Patent: May 9, 2017

(54) LIQUID EJECTING APPARATUS

(71) Applicant: SEIKO EPSON CORPORATION, Tokyo (JP)

(72) Inventors: Masahiko Sato, Matsumoto (JP); Keiji Matsumoto, Matsumoto (JP); Shigenori Nakagawa, Tatsuno machi (JP); Toshinobu Yamazaki, Niigata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/939,177

(22) Filed: Nov. 12, 2015

(65) Prior Publication Data

US 2016/0144628 A1 May 26, 2016

(30) Foreign Application Priority Data

Nov. 21, 2014 (JP) ..... 2014-236784

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
CPC B41J 2/17513; B41J 2/17596; B41J 2/17556; B41J 2/19
USPC ..... 347/17, 84, 85, 86, 92
See application file for complete search history.

(56) References Cited

U.S. PATENT DOCUMENTS

| | | | |
|---|---|---|---|
| 4,961,082 | A | 10/1990 | Hoisington et al. |
| 2007/0008384 | A1 | 1/2007 | Koseki |
| 2008/0204506 | A1 | 8/2008 | Nakamura et al. |
| 2010/0026755 | A1 | 2/2010 | Nishida |
| 2010/0045757 | A1 | 2/2010 | Ito |
| 2010/0149288 | A1 | 6/2010 | Hamasaki et al. |

FOREIGN PATENT DOCUMENTS

| | | |
|---|---|---|
| JP | 01-502504 | 8/1989 |
| JP | 2007-030495 | 2/2007 |
| JP | 2008-173789 | 7/2008 |
| JP | 2008-238815 | 10/2008 |
| JP | 2010-030254 | 2/2010 |
| JP | 2010-162871 | 7/2010 |
| JP | 2010-208187 | 9/2010 |
| JP | 2011-255643 | 12/2011 |
| JP | 2013-248894 | 12/2013 |
| WO | 88-08515 | 11/1988 |

*Primary Examiner* — Jannelle M Lebron
(74) *Attorney, Agent, or Firm* — Workman Nydegger

(57) ABSTRACT

A liquid ejecting apparatus includes a liquid ejecting unit which can eject liquid from a nozzle; a supply flow path through which liquid is supplied to the nozzle; a pressure adjusting unit which includes a pressure chamber which can store liquid; a storage chamber at least a part of which is formed by a gas permeable unit, and which stores liquid; a connection flow path which connects a space including a flow path portion from the pressure chamber to the nozzle and the pressure chamber, and the storage chamber; an opening-closing valve which can switch a communicating state between the space and the storage chamber through the connection flow path; and a pressurizing unit which pressurizes the storage chamber when the opening-closing valve is in the closed state.

10 Claims, 6 Drawing Sheets

LIQUID EJECTING APPARATUS

BACKGROUND

1. Technical Field

The present invention relates to a liquid ejecting apparatus such as an ink jet printer.

2. Related Art

In the related art, an ink jet printer which performs printing by ejecting ink as an example of liquid which is stored in a liquid accommodation unit onto a medium from a liquid ejecting unit has been known. In such a printer, there is a printer which includes a pressure adjusting unit (pressure adjusting valve) which is also referred to as a self-sealing valve in the middle of a supply flow path of ink from the liquid accommodation unit to the liquid ejecting unit (for example, JP-A-2011-255643).

The pressure adjusting unit includes a pressure chamber which stores ink, and allows the supply of ink from the liquid accommodation unit to the liquid ejecting unit when the pressure of ink in the pressure chamber becomes low due to consumption of ink in the liquid ejecting unit. On the other hand, when a pressure of ink in the pressure chamber becomes high due to a supply of ink from the liquid accommodation unit, the pressure adjusting unit regulates the supply of ink from the liquid accommodation unit to the liquid ejecting unit. In this manner, the pressure adjusting unit adjusts a supplying pressure of ink with respect to the liquid ejecting unit so that the pressure of ink in a nozzle becomes a pressure which can form a meniscus.

Meanwhile, in such a printer, there is a case in which bubbles flow into a pressure chamber of a pressure adjusting unit, and in the related art, such bubbles are discharged from the pressure chamber along with ink through the liquid ejecting unit. However, in such a case, when bubbles remain in the liquid ejecting unit or a nozzle, there is a concern that the ejecting properties of liquid of the liquid ejecting unit may be influenced.

Such a problem is not limited to an ink jet printer, and is generally common to a liquid ejecting apparatus in which a pressure adjusting unit is arranged in a supply flow path through which liquid is supplied to a liquid ejecting unit.

SUMMARY

An advantage of some aspects of the invention is to provide a liquid ejecting apparatus in which bubbles are discharged from a pressure adjusting unit not through a liquid ejecting unit.

According to an aspect of the invention, there is provided a liquid ejecting apparatus including: a liquid ejecting unit which can eject liquid from a nozzle; a supply flow path through which liquid is supplied to the nozzle; a pressure adjusting unit which includes a pressure chamber which can store liquid provided in the middle of the supply flow path, allows a supply of liquid to the nozzle side when the pressure in the pressure chamber is less than a reference pressure which is smaller than an external pressure in the pressure chamber, and regulates a supply of liquid to the nozzle side when the pressure in the pressure chamber is equal to or greater than the reference pressure; a storage chamber at least a part of which is formed by a gas permeable unit, and which stores liquid; a connection flow path which connects a space including a flow path portion from the pressure chamber to the nozzle in the supply flow path and the pressure chamber, and the storage chamber; an opening-closing valve which can be switched from an open state in which the space and the storage chamber are set to a communicating state through the connection flow path to a closed state in which the space and the storage chamber are set to a non-communicating state through the connection flow path; and a pressurizing unit which pressurizes the storage chamber when the opening-closing valve is in the closed state.

According to the configuration, when a pressure in a pressure chamber becomes less than a reference pressure when liquid is ejected from a nozzle, liquid is supplied to the nozzle through the pressure chamber. When the pressure in the pressure chamber becomes equal to or greater than the reference pressure when liquid flows into the pressure chamber, liquid is not supplied to the nozzle side. In this manner, the pressure of the liquid which is supplied to a nozzle is adjusted by the pressure adjusting unit. In addition, when ejecting liquid (when supplying ink), an opening-closing valve enters a closed state, and the pressure chamber and a storage chamber do not communicate through a connection flow path.

When bubbles are included in liquid which is supplied from a liquid accommodation unit, since bubbles which flow into a pressure chamber and a downstream side of the pressure chamber, are going to float vertically upward, the bubbles float to a vertically higher part of the space including a flow path portion from a pressure chamber to a nozzle in a supply flow path, and the pressure chamber.

By switching the opening-closing valve from a closed state to an open state, a space including a flow path portion from a pressure chamber to a nozzle and the pressure chamber, and the storage chamber are caused to communicate through a connection flow path, and bubbles are caused to flow into the storage chamber. Subsequently, by switching the opening-closing valve from the open state to the closed state, the storage chamber is pressurized in a state in which the space including the flow path portion from the pressure chamber to the nozzle and the pressure chamber, and the storage chamber are caused not to communicate through the connection flow path. Then, bubbles which flow into the storage chamber are discharged (de-gassed) to the outside of the storage chamber through a gas permeable unit, when the pressure in the storage chamber becomes high.

In this manner, according to the configuration, it is possible to cause bubbles which flow into the pressure chamber, or the downstream side of the pressure chamber to flow into the storage chamber. In addition, the bubbles which flow into the storage chamber can be discharged (de-gassed) to the outside through the gas permeable unit which configures a part of the storage chamber. In this manner, it is possible to discharge bubbles from the pressure adjusting unit, not through a nozzle.

In the liquid ejecting apparatus, it is preferable that the pressurizing unit is a pressurizing supply unit which supplies liquid accommodated in a liquid accommodation unit toward the liquid ejecting unit in a pressurized manner.

According to the configuration, it is possible to pressurize the storage chamber using the pressurizing supply unit which is provided in the liquid ejecting apparatus in order to supply liquid from the liquid accommodation unit to the liquid ejecting unit. For this reason, it is not necessary to separately provide a configuration for pressurizing the storage chamber, and it is possible to simplify a configuration of the liquid ejecting apparatus.

In the liquid ejecting apparatus, it is preferable that the supply flow path supplies liquid accommodated in the liquid accommodation unit to the pressure chamber through the storage chamber.

When liquid accommodated in the liquid accommodation unit is supplied to the pressure chamber and not through the storage chamber, there is a concern that liquid which flows into the storage chamber may easily stay in the storage chamber, and may deteriorate, or the like, in the storage chamber. In contrast to this, according to the configuration, since liquid accommodated in the liquid accommodation unit is supplied to the pressure chamber through the storage chamber, it is possible to prevent liquid in the liquid accommodation unit from staying in the storage chamber, or deteriorating in the storage chamber.

It is preferable that the liquid ejecting apparatus further includes an external force applying unit which applies an external force to the gas permeable unit, in which the gas permeable unit is flexible, and the external force applying unit switches the opening-closing valve from the closed state to the open state by causing the gas permeable unit to be displaced in a direction in which a volume of the storage chamber is reduced.

According to the configuration, it is possible to change whether to set a state of the opening-closing valve to an open state or to a closed state depending on whether or not to apply an external force to the gas permeable unit. For this reason, it is possible to easily switch a state of the opening-closing valve.

It is preferable that the liquid ejecting apparatus further includes a pressurizing chamber which is partitioned from the storage chamber through the gas permeable unit, in which the external force applying unit applies an external force to the gas permeable unit by pressurizing the pressurizing chamber.

According to the configuration, it is possible to select whether or not to apply an external force to the gas permeable unit by changing a pressurization form of the pressurizing chamber.

In the liquid ejecting apparatus, it is preferable that the gas permeable unit is provided at a vertically higher part of the storage chamber.

According to the configuration, since the gas permeable unit is provided at the vertically higher part of the storage chamber, bubbles which flow into the storage chamber float to a position which comes into contact with the gas permeable unit. For this reason, when pressurizing the storage chamber, it is possible to easily discharge (de-gas) bubbles through the gas permeable unit.

In the liquid ejecting apparatus, it is preferable that the opening-closing valve includes a sealing member which is provided in the storage chamber, and can open or close an introducing port which causes the connection flow path and the storage chamber to communicate, and the opening-closing valve is set to the closed state when the sealing member closes the introducing port, and is set to the open state when the sealing member opens the introducing port.

According to the configuration, since the sealing member opens or closes the introducing port which communicates with the connection flow path from the storage chamber side, it is possible to switch the opening-closing valve to an open state in a state in which bubbles float to the vicinity of the storage chamber, compared to a case in which the outlet which causes the connection flow path and the pressure chamber to communicate is open or closed from the pressure chamber side. Accordingly, it is possible to easily introduce bubbles which float to the vicinity of the storage chamber to the storage chamber when the opening-closing valve is set to the open state.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to drawings. The liquid ejecting apparatus is, for example, an ink jet printer which performs printing on a medium by ejecting ink as an example of liquid onto the medium such as a sheet. In the following descriptions, for ease of descriptions, in a part of drawings, only an arbitrary configuration is illustrated using a section.

Figure 1:
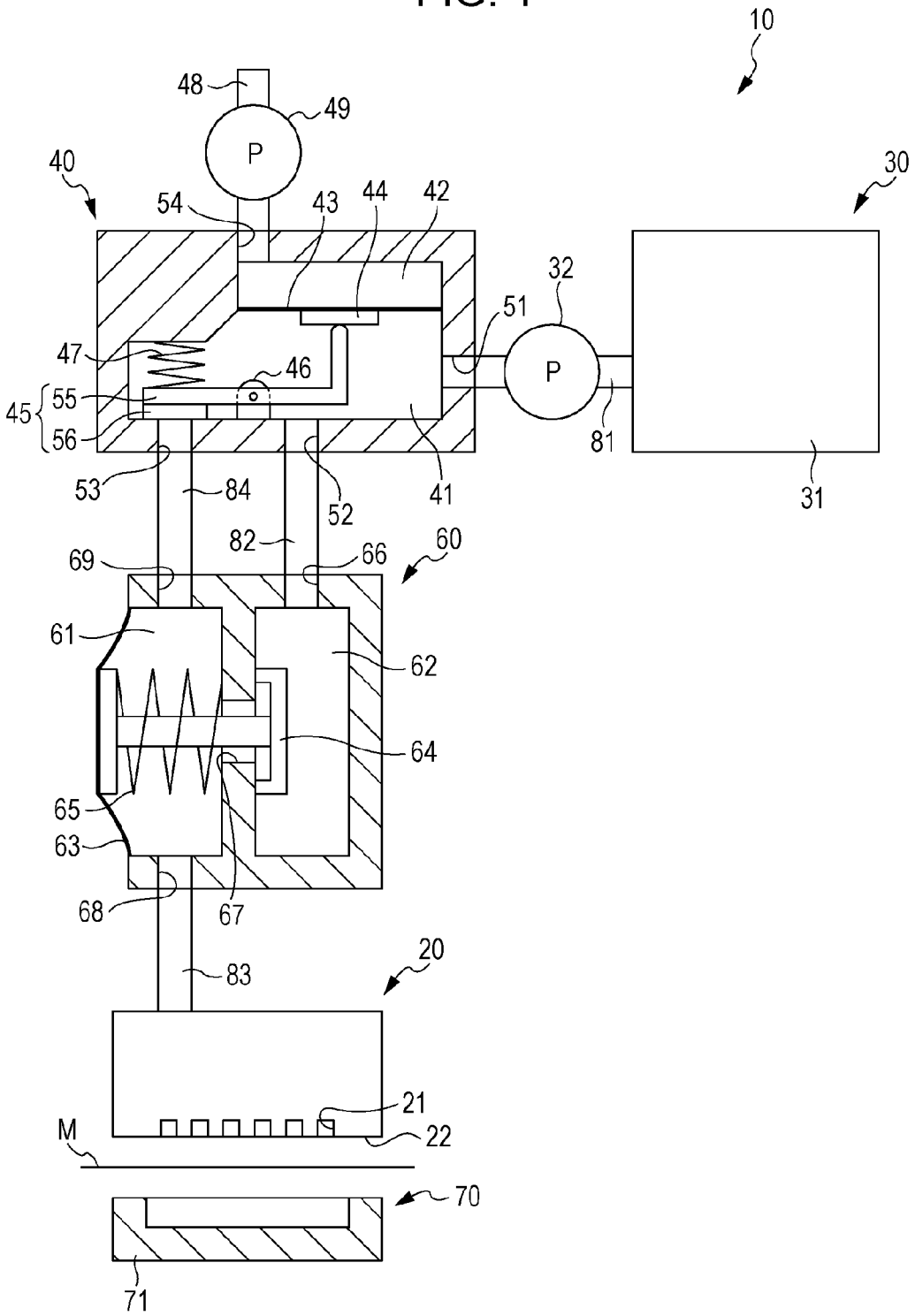
FIG. 1 is a diagram which illustrates a schematic configuration of a liquid ejecting apparatus.

As illustrated in FIG. 1, a liquid ejecting apparatus 10 includes a liquid ejecting unit 20 which ejects liquid, a liquid supply unit 30 which supplies liquid to the liquid ejecting unit 20, a bubble discharging unit 40 which discharges bubbles included in liquid which is supplied to the liquid ejecting unit 20, a pressure adjusting unit 60 which adjusts the pressure of liquid supplied to the liquid ejecting unit 20, and a maintenance unit 70 which performs maintenance of the liquid ejecting unit 20.

The liquid ejecting apparatus 10 further includes a first supply flow path 81 which connects the liquid supply unit 30 and the bubble discharging unit 40, a second supply flow path 82 which connects the bubble discharging unit 40 and the pressure adjusting unit 60, and a third supply flow path 83 which connects the pressure adjusting unit 60 and the liquid ejecting unit 20. In addition, the liquid ejecting apparatus 10 includes a connection flow path 84 which connects the bubble discharging unit 40 and the pressure adjusting unit 60 by being parallel to the second supply flow path 82. In the following descriptions, the upstream and the downstream will be referred to along a supply direction of liquid.

The liquid ejecting unit 20 includes a nozzle forming face 22 on which a plurality of nozzles 21 are formed. The liquid ejecting unit 20 ejects liquid which is supplied from the liquid supply unit 30 toward a medium M from the plurality of nozzles 21. For example, when an ink jet printer is an example of the liquid ejecting apparatus 10, characters or an image is printed on a medium M when ink is ejected to the medium M such as a sheet. When liquid is not ejected from the nozzle 21, liquid in the liquid ejecting unit 20 (in nozzle 21) is maintained at a negative pressure so that liquid does not flow out from the nozzle 21.

The liquid supply unit 30 includes a liquid accommodation unit 31 which accommodates liquid, and a first pressurizing unit 32 which supplies liquid toward the liquid ejecting unit 20 in a pressurized manner. The liquid accommodation unit 31 is a bag-shaped container which is formed of a flexible material. The first pressurizing unit 32 corresponds to an example of a "pressurizing supply unit", and is a diaphragm pump, for example.

The liquid supply unit 30 supplies liquid which is accommodated in the liquid accommodation unit 31 to the liquid ejecting unit 20 in a pressurized manner through the first supply flow path 81, the second supply flow path 82, and the third supply flow path 83. For this reason, a region which communicates with the first pressurizing unit 32 becomes a positive pressure (for example, 20 kPa to 40 kPa).

In this point, according to the embodiment, the first supply flow path 81, the second supply flow path 82, and the third supply flow path 83 correspond to an example of a "supply flow path" which supplies liquid accommodated in the liquid accommodation unit 31 to the liquid ejecting unit 20.

As illustrated in FIG. 1, the bubble discharging unit 40 includes a storage chamber 41 which stores a fluid including liquid and bubbles (hereinafter, also referred to as "bubbles bu"), and a pressurizing chamber 42 which causes volume to be changed according to a change in pressure. The bubble discharging unit 40 includes a gas permeable unit 43 which has gas permeability, a pressing plate 44 which is attached to the gas permeable unit 43, an opening-closing valve 45 which switches a communication form between the pressure adjusting unit 60 (pressure chamber 61) and the storage chamber 41, a support member 46 which slidably (rotatably) supports the opening-closing valve 45, and an urging member 47 which urges the opening-closing valve 45. In addition, the bubble discharging unit 40 further includes a pressurizing flow path 48 which communicates with the pressurizing chamber 42, and a second pressurizing unit 49 which pressurizes the pressurizing chamber 42.

An inflow port 51 which causes liquid to flow into the storage chamber 41, an outflow port 52 which causes liquid to flow out from the storage chamber 41, an introducing port 53 which introduces bubbles bu to the storage chamber 41, and a supply port 54 through which air is supplied to the pressurizing chamber 42 are provided in the bubble discharging unit 40. The inflow port 51 is connected to a downstream end of the first supply flow path 81, the outflow port 52 is connected to an upstream end of the second supply flow path 82, the introducing port 53 is connected to one end of the connection flow path 84, and the supply port 54 is connected to one end of a pressurizing flow path 48.

The gas permeable unit 43 which configures a part of the storage chamber 41 is provided at a vertically higher part of the storage chamber 41 in the storage chamber 41. The gas permeable unit 43 has a flexible (elastic) film shape, and partitions the storage chamber 41 and the pressurizing chamber 42. The gas permeable unit 43 is formed of a material which allows permeation of air while suppressing permeation of liquid so as to function as a gas-liquid separating membrane.

For this reason, it is preferable to form the gas permeable unit 43 using silicone rubber of which gas permeability is high compared to other rubbers, for example. In addition, since silicone rubber has high water resistance and solvent resistance, it is preferable when using water based ink and solvent based ink as an example of liquid.

The opening-closing valve 45 is a lever member 55 which has an approximately L shape and a sealing member 56 which allows or regulates the circulation of liquid through the introducing port 53. In the lever member 55, a base end portion which is an opposite side to a tip end portion in which the sealing member 56 is provided and is subjected to rounding processing. The lever member 55 and the pressing plate 44 are formed of a hard material compared to that of the gas permeable unit 43. In this manner, when the pressing plate is displaced in a direction of pressing the base end portion of the lever member 55 along with the gas permeable unit 43, the lever member 55 slides around a point which is supported by the support member 46 while being in sliding contact with the pressing plate 44.

The urging member 47 urges the sealing member 56 in a direction of closing an opening of the introducing port 53 by urging the opening-closing valve 45 in the storage chamber 41. In this manner, the sealing member 56 regulates the circulation of fluid between the pressure adjusting unit 60 (pressure chamber 61) and the storage chamber 41 by closing the introducing port 53 from the storage chamber 41 side. In addition, the sealing member 56 allows circulation of fluid between the pressure adjusting unit 60 (pressure chamber 61) and the storage chamber 41 by opening the introducing port 53.

The second pressurizing unit 49 is, for example, a tube type pump which can supply air to the pressurizing chamber 42 through the predetermined flow path 48. In the pressurizing flow path 48, an end portion on a side opposite to an end portion which communicates with the supply port 54 communicates with atmospheric air. In addition, the second pressurizing unit 49 displaces the gas permeable unit 43 in a direction in which the volume of the pressurizing chamber 42 is increased (direction in which volume of storage chamber 41 is decreased) by causing air to flow into the pressurizing chamber 42 and pressurizing the pressurizing chamber 42. In this point, according to the embodiment, the second pressurizing unit 49 corresponds to an example of an "external force applying unit" which applies an external force to the gas permeable unit 43 by pressurizing the pressurizing chamber 42.

As illustrated in FIG. 1, the pressure adjusting unit 60 includes the pressure chamber 61 which stores liquid using pressure that is below atmospheric pressure (negative pressure), and a supply chamber 62 which stores liquid using a pressure equal to or above atmospheric pressure (positive pressure), when the pressure in a space on the outer side of the pressure adjusting unit 60 is set to atmospheric pressure. In addition, the pressure adjusting unit 60 includes a flexible unit 63 which has flexibility (elasticity), a valve 64 which allows or regulates a circulation of liquid between the pressure chamber 61 and the supply chamber 62, and an urging member 65 which urges the valve 64 and the flexible unit 63 in the pressure chamber 61.

An inflow port 66 which causes liquid to flow into the supply chamber 62, a communication flow path 67 which causes the supply chamber 62 and the pressure chamber 61 to communicate, an outflow port 68 which causes liquid to flow out from the pressure chamber 61, and an outlet 69 which lets out bubbles bu from the pressure chamber 61 are formed in the pressure adjusting unit 60. A downstream end of the second supply flow path 82 is connected to the inflow port 66, an upstream end of the third supply flow path 83 is connected to the outflow port 68, and the other end of the connection flow path 84 is connected to the outlet 69.

In the pressure chamber 61, the outflow port 68 is provided at a vertically lower part, and the outlet 69 is provided at a vertically higher part thereof. In this point, it can be said that the connection flow path 84 connects a vertically higher part of the space including a flow path portion from the pressure chamber 61 to the liquid ejecting unit 20 (third supply flow path 83) in the supply flow path and the pressure chamber 61, and the storage chamber 41. The pressure chamber 61 is provided at the vertically lower part of the storage chamber 41, and the third supply flow path 83 is provided at the vertically lower part of the pressure chamber 61.

The flexible unit 63 has a film shape, and partitions the pressure chamber 61 and an outer space (atmosphere). It is preferable that the flexible unit 63 is formed of a material with low gas permeability (high gas barrier property), and high resistance and solvent resistance. In addition, the flexible unit 63 is displaced in a direction in which the volume of the pressure chamber 61 increases or decreases according to a pressure difference between the pressure chamber 61 and the outer space (atmosphere).

The valve 64 is provided over the pressure chamber 61 and the supply chamber 62 in a state of being in contact with the flexible unit 63 in the pressure chamber 61. The valve 64 allows or regulates a flow of liquid from the supply chamber 62 to the pressure chamber 61 by opening or closing an opening of the communication flow path 67 on the supply chamber 62 side depending on the displacement magnitude of the flexible unit 63.

The urging member 65 urges the valve 64 in a direction which goes from the supply chamber 62 side to the pressure chamber 61 side so that the valve 64 closes an opening on the supply chamber 62 side of the communication flow path 67. In addition, the urging member 65 urges the flexible unit 63 in a direction in which the volume of the pressure chamber 61 increases through the valve 64. For this reason, when the pressure of the outer space of the pressure chamber 61 is atmospheric pressure, the pressure in the pressure chamber 61 and a region which communicates with the pressure chamber 61 is set to a negative pressure (for example, −1 kPa±0.5 kPa). In the following descriptions, a pressure in the pressure chamber 61 when the valve 64 closes the opening of the communication flow path 67 is referred to as a "reference pressure".

In this manner, as illustrated in FIG. 1, according to the embodiment, liquid which is accommodated in the liquid accommodation unit 31 is supplied to the liquid ejecting unit 20 through the first supply flow path 81, the storage chamber 41, the second supply flow path 82, the supply chamber 62, the pressure chamber 61, and the third supply flow path 83. For this reason, the first supply flow path 81 and the second supply flow path 82 as an example of the "supply flow path" supply liquid which is accommodated in the liquid accommodation unit 31 to the pressure chamber 61 through the storage chamber 41.

According to the embodiment, when the pressure chamber 61 and the supply chamber 62 do not communicate due to the valve 64, the pressure of liquid in the first supply flow path 81, the storage chamber 41, the second supply flow path 82, and the supply chamber 62 is set to a positive pressure, and the pressure of liquid in the pressure chamber 61 and the third supply flow path 83 is set to a negative pressure.

The maintenance unit 70 includes a cap 71 which has a bottomed box shape. The cap 71 can relatively move to the liquid ejecting unit 20. The cap 71 performs "capping" which forms a closed space including an opening of a nozzle 21 of the liquid ejecting unit 20 by coming into contact with the nozzle forming face 22. The capping is performed in order to suppress evaporation of liquid from the nozzle 21 of the liquid ejecting unit 20 when liquid is not ejected from the liquid ejecting unit 20 for a long time, for example, a case in which power of the liquid ejecting apparatus 10 is turned off, or the like.

Subsequently, operations of the liquid ejecting apparatus 10 according to the embodiment will be described with reference to FIGS. 2 to 4.

Figure 2:
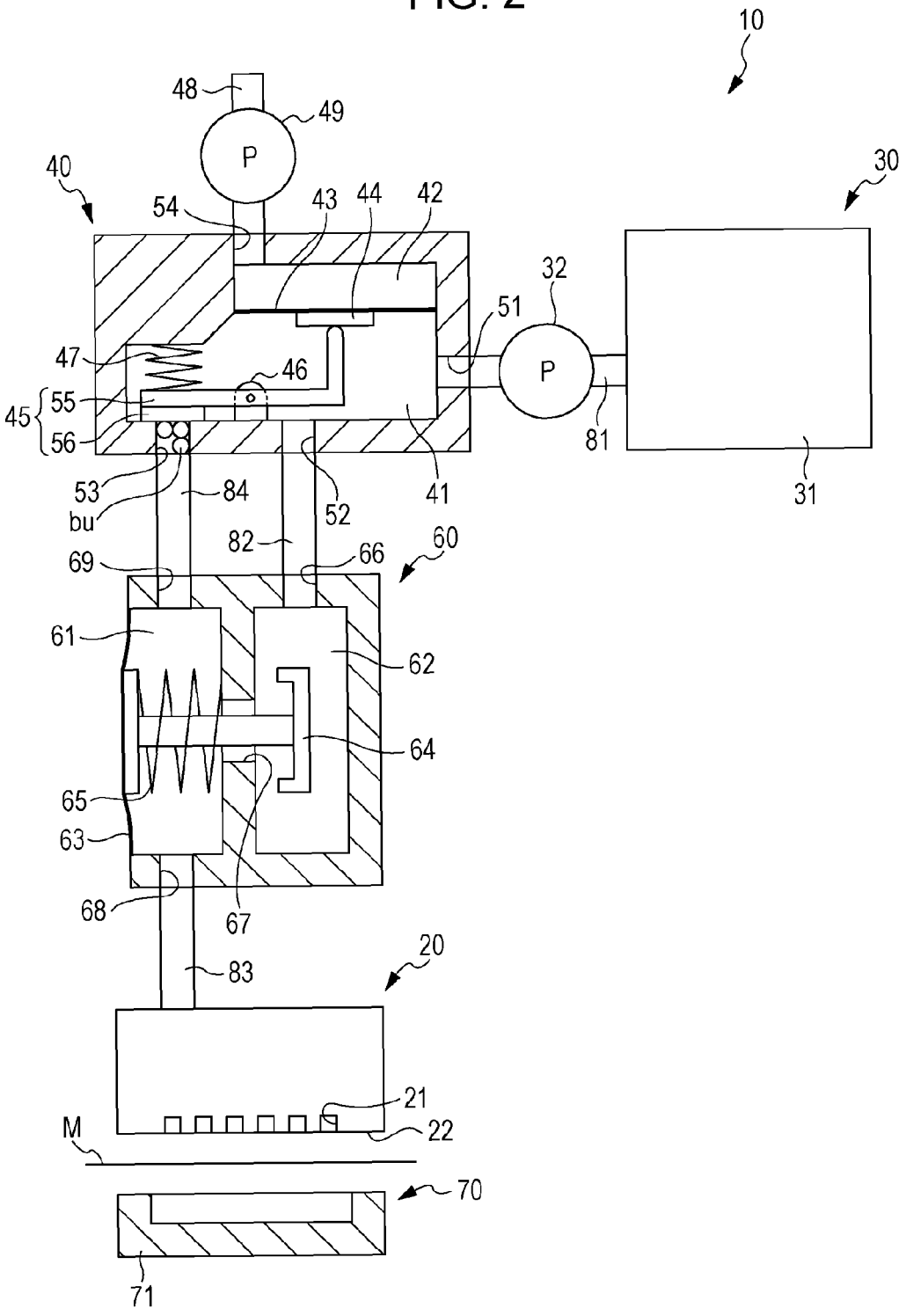
FIG. 2 is a diagram which illustrates a schematic configuration of the liquid ejecting apparatus in a liquid supply process.

As illustrated in FIG. 2, when liquid is ejected from the nozzle 21 of the liquid ejecting unit 20 onto the medium M, an amount of liquid which is consumed in the liquid ejecting unit 20 is supplied from the pressure chamber 61 which communicates with the nozzle 21 of the liquid ejecting unit 20. As a result, the pressure in the pressure chamber 61 decreases, and the flexible unit 63 is displaced in a direction of decreasing the volume of the pressure chamber 61.

When the pressure in the pressure chamber 61 becomes less than the reference pressure, the pressure chamber 61 and the supply chamber 62 communicate when the valve 64 which is pressed by the flexible unit 63 which opens the communication flow path 67 while compressing the urging member 65.

Here, since the supply chamber 62 is in a state in which the pressure is higher than the reference pressure, and on the other hand, the pressure chamber 61 is in a state in which the pressure is less than the reference pressure, liquid flows into the pressure chamber 61 from the supply chamber 62 through the communication flow path 67.

Meanwhile, in the pressure chamber 61, when the quantity of flow of liquid which flows into the pressure chamber 61 (quantity of flow supplied from supply chamber 62) exceeds quantity of flow of liquid which flows out from the pressure chamber 61 (quantity of flow supplied to liquid ejecting unit 20), the pressure in the pressure chamber 61 increases, and the pressure chamber 61 is displaced in a direction in which the flexible unit 63 increases the volume of the pressure chamber 61. When the pressure in the pressure chamber 61 becomes a pressure which is the reference pressure or greater, the pressure chamber 61 and the supply chamber 62 do not communicate since the valve 64 on which a restoring force of the urging member 65 acts closes the communication flow path 67.

In this manner, the pressure adjusting unit 60 allows the supply of liquid from the liquid accommodation unit 31 to the liquid ejecting unit 20 side by allowing communication between the liquid accommodation unit 31 and the liquid ejecting unit 20, when the pressure in the pressure chamber 61 is less than the reference pressure. On the other hand, the pressure adjusting unit 60 regulates the supply of liquid from the liquid accommodation unit 31 to the liquid ejecting unit 20 side by regulating communication between the liquid accommodation unit 31 and the liquid ejecting unit 20, when the pressure in the pressure chamber 61 is the reference pressure or greater. In this manner, the pressure adjusting unit 60 adjusts the pressure of liquid which is supplied to the liquid ejecting unit 20. In the following descriptions, the above described process in which liquid is supplied from the liquid accommodation unit 31 to the liquid ejecting unit 20 is also referred to as a "liquid supply process". Since the liquid supply process is performed when liquid is ejected (consumed) in the liquid ejecting unit 20, it can also be referred to as a liquid ejecting process.

Meanwhile, in the liquid supply process, there is a case in which bubbles bu are included in liquid which is supplied from the liquid accommodation unit 31. As an example, there is a case in which bubbles bu are supplied together with liquid when the bubbles bu are mixed into the liquid accommodation unit 31 or the first supply flow path 81 when exchanging the liquid accommodation unit 31. In such a case, when liquid including bubbles bu is supplied to the liquid ejecting unit 20, there is a concern that an ejecting failure of liquid may occur.

In this point, according to the embodiment, in the pressure chamber 61, since the outflow port 68 which communicates with the liquid ejecting unit 20 is provided at the vertically lower part which is a direction opposite to the vertically higher part which is the direction in which bubbles bu float, the bubbles bu which flow into the pressure chamber 61 are hardly supplied to the liquid ejecting unit 20.

Since the outlet 69 which communicates with the bubble discharging unit 40 is formed at the vertically higher part of the pressure chamber 61, bubbles bu which flow into the pressure chamber 61 float in the pressure chamber 61 and the connection flow path 84, and stay in the vicinity of the introducing port 53 which is closed due to the sealing member 56 of the bubble discharging unit 40 (refer to FIG. 2). In this manner, since the bubbles bu which flow into the pressure chamber 61 stay in the vicinity of the introducing port 53 which is located at the vertically higher part of the pressure chamber 61, and in which there is no flow of liquid which goes toward the liquid ejecting unit 20, the bubbles bu are hardly supplied to the liquid ejecting unit 20.

Figure 3:
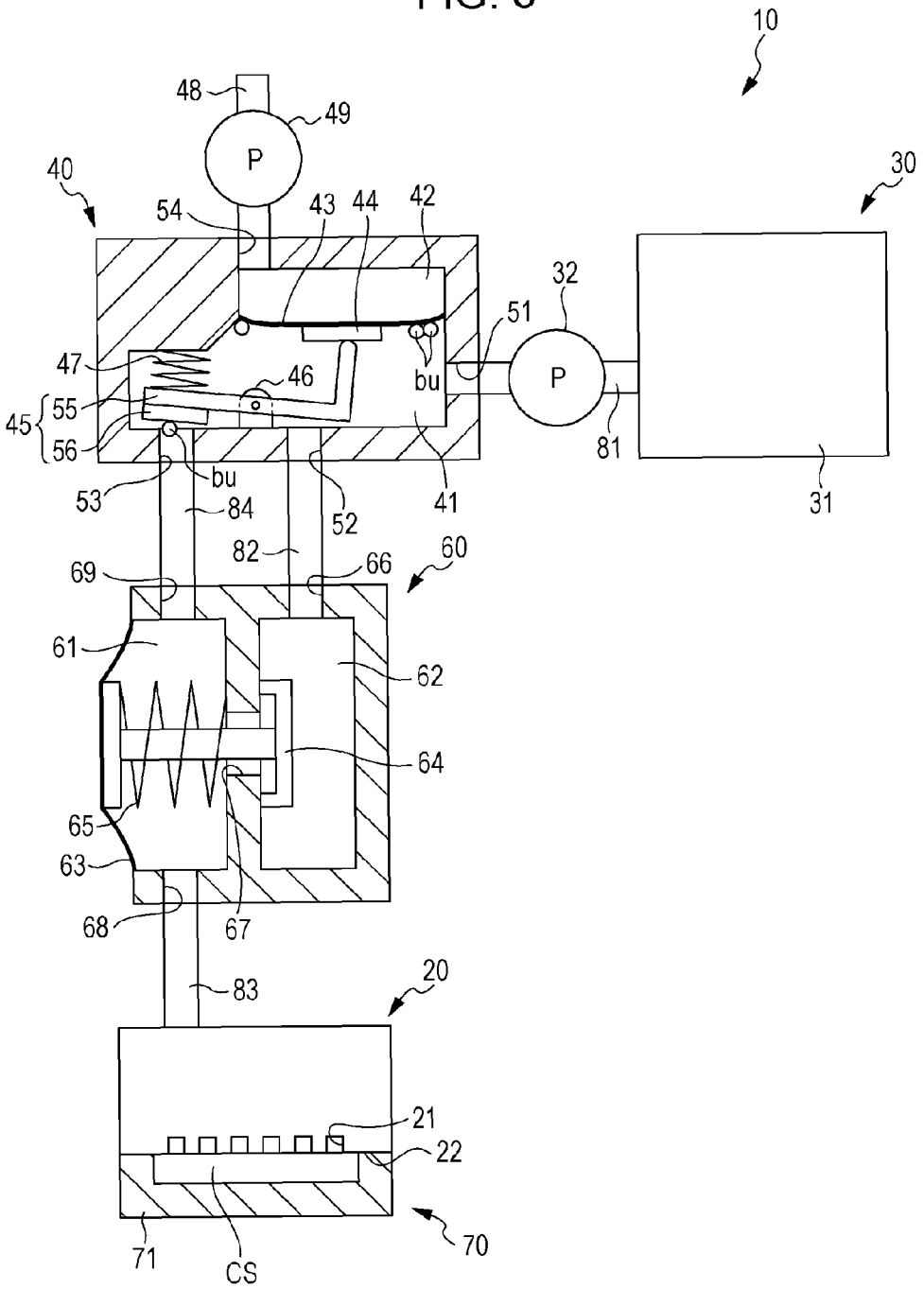
FIG. 3 is a diagram which illustrates a schematic configuration of the liquid ejecting apparatus in a bubble introducing process.

As illustrated in FIG. 3, a "bubble introducing process" in which bubbles bu are caused to flow into the storage chamber 41 is performed by causing the pressure chamber 61 and the storage chamber 41 to communicate through the connection flow path 84, by switching the opening-closing valve 45 from a closed state to an open state. In detail, in the bubble introducing process, the gas permeable unit 43 is displaced in a direction in which a volume of the storage chamber 41 is reduced by pressurizing the pressurizing chamber 42 by driving the second pressurizing unit 49, first. In addition, the lever member 55 of the opening-closing valve 45 is pressed using the pressing plate 44 which is displaced along with the gas permeable unit 43.

Then, the lever member 55 slides around a point which is supported by the support member 46 in a direction in which the urging member 47 is compressed, and the sealing member 56 of the opening-closing valve 45 opens the introducing port 53. In this manner, the opening-closing valve 45 is switched from a closed state in which the pressure chamber 61 and the storage chamber 41 are set to a non-communicating state through the connection flow path 84 to an open state in which the pressure chamber 61 and the storage chamber 41 are set to a communicating state through the connection flow path 84. As a result, the bubbles bu which stay in the vicinity of the introducing port 53 are introduced to the storage chamber 41, and float in the storage chamber 41 up to a position of being in contact with the gas permeable unit 43 which is provided at the vertically higher part in the storage chamber 41. Incidentally, the bubble introducing process may be performed when a liquid supply process is continued for a predetermined period, for example.

Since the bubble introducing process is performed when liquid is not ejected from the liquid ejecting unit 20, if the opening-closing valve 45 is switched from a closed state to an open state, the process is performed in a state in which the supply chamber 62 and the pressure chamber 61 do not communicate in the pressure adjusting unit 60. Accordingly, when the opening-closing valve 45 is switched from the closed state to the open state, liquid flows from the storage chamber 41 in a positive pressure state to the pressure chamber 61 in a negative pressure state.

Here, in a case in which the flow velocity of liquid which flows from the storage chamber 41 to the pressure chamber 61 is fast when switching the opening-closing valve 45 to an open state, bubbles bu which stay in the introducing port 53 are hardly introduced to the storage chamber 41 compared to a case in which the flow velocity is slow. In other words, bubbles bu which stay in the vicinity of the introducing port 53 easily flow to the downstream side along with a flow of liquid which circulates toward the pressure chamber 61 from the storage chamber 41.

Accordingly, it is preferable that the flow velocity of liquid which flows from the storage chamber 41 to the pressure chamber 61 when the opening-closing valve 45 is switched to an open state is slow so that bubbles bu can float against the flow of liquid from the storage chamber 41 to the pressure chamber 61, when the opening-closing valve 45 is switched to the open state.

For this reason, it is preferable to set a sectional area (sectional area of flow path) of the introducing port 53 to be large in order to make the flow velocity of liquid which flows from the storage chamber 41 to the pressure chamber 61 slow. Specifically, it is preferable to determine a size of a sectional area of a flow path in consideration of the pressure difference between the storage chamber 41 and the pressure chamber 61 when switching the opening-closing valve 45 to an open state, the size of bubbles which stay in the vicinity of the introducing port 53 of the storage chamber 41, or the like.

When performing the bubble introducing process, liquid which flows into the pressure chamber 61 in a negative pressure state from the storage chamber 41 in a positive pressure state is supplied to the liquid ejecting unit 20 through the third supply flow path 83, and flows out from the nozzle 21 of the liquid ejecting unit 20.

For this reason, it is preferable to perform capping of the liquid ejecting unit 20 (refer to FIG. 3) before switching the opening-closing valve 45 to an open state in the bubble introducing process. By doing so, by switching the opening-closing valve 45 to the open state, a closed space CS including an opening of the nozzle 21 of the liquid ejecting unit 20 is formed before the flow of liquid out from the nozzle 21 is started.

When an outflow amount of liquid from the nozzle 21 increases, the pressure in the closed space CS gradually increases, and liquid hardly flows out from the nozzle 21. Since it is not possible to make an amount of liquid equal to or greater than a capacity of the closed space CS flow out from the nozzle 21, the amount of consumed liquid in the bubble introducing process is suppressed to the capacity of the closed space CS or less at most.

If driving of the first pressurizing unit 32 is continued when the bubble introducing process is performed, a positive pressure state (pressurizing state) of the storage chamber 41 is maintained even when liquid flows into the pressure chamber 61 from the storage chamber 41, and liquid endlessly flows out from the nozzle 21 in the liquid ejecting unit 20. Therefore, in the bubble introducing process, it is preferable to stop a pressurizing supply of liquid using the first pressurizing unit 32 before switching the opening-closing valve 45 from a closed state to an open state.

By doing so, liquid flows into the pressure chamber 61 from the storage chamber 41 immediately after switching the opening-closing valve 45 to an open state; however, since a pressure difference between the storage chamber 41 and the pressure chamber 61 becomes gradually small, quantity of flow of liquid which flows into the pressure chamber 61 from the storage chamber 41 becomes gradually small. In this manner, an increase in consumption amount of liquid in the bubble introducing process is suppressed compared to a case in which driving of the first pressurizing unit 32 is continued.

When the bubble introducing process is completed, a "bubble discharging process" for discharging bubbles bu from the storage chamber 41 is performed by switching the opening-closing valve 45 to a closed state, and pressurizing the storage chamber 41. Whether or not the bubble introducing process is completed may be determined, for example, by obtaining a time in which it is expected that bubbles bu which stay in the vicinity of the introducing port 53 are introduced to the storage chamber 41 through an experiment, or the like, in advance, and by comparing the time to an elapsed time after setting the opening-closing valve 45 to the open state.

In the bubble discharging process, first, the gas permeable unit 43 is displaced in a direction in which a volume of the supply chamber 62 is increased by stopping the driving of the second pressurizing unit 49, and opening the pressurizing chamber 42 to the atmosphere. Then, a pressing state of the opening-closing valve 45 using the pressing plate 44 which is attached to the gas permeable unit 43 is released, and a restoring force of the urging member 47 acts on the lever member 55. As a result, the lever member 55 slides around the point which is supported by the support member 46 in a direction in which the urging member 47 stretches, and the sealing member 56 closes the introducing port 53.

In this manner, the opening-closing valve 45 is switched from the open state in which the pressure chamber 61 and the storage chamber 41 are set to a communicating state through the connection flow path 84 to the closed state in which the pressure chamber 61 and the storage chamber 41 are set to a non-communicating state through the connection flow path 84. That is, the opening-closing valve 45 enters the state illustrated in FIG. 1.

Figure 4:
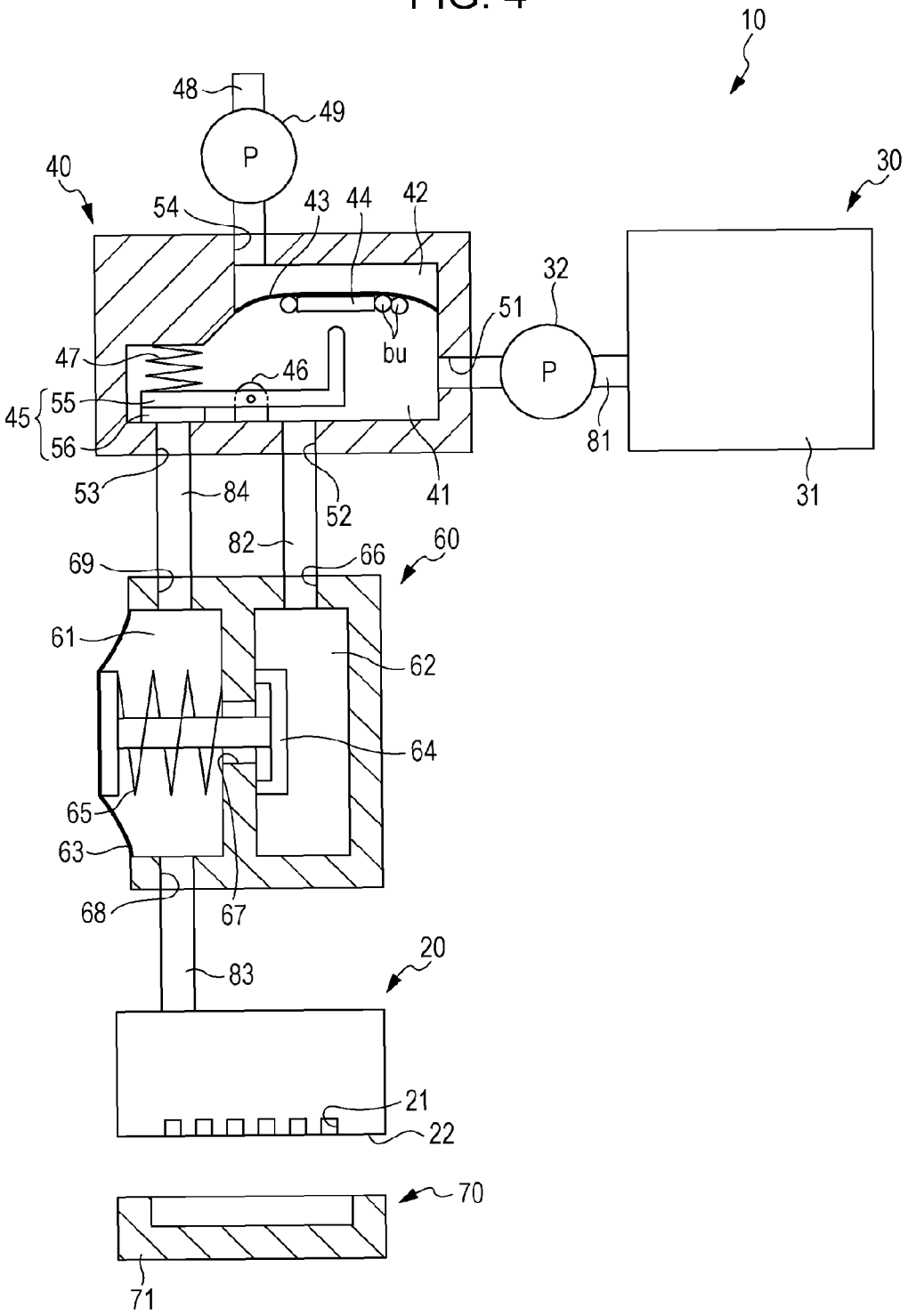
FIG. 4 is a diagram which illustrates a schematic configuration of the liquid ejecting apparatus in a bubble discharging process.

Subsequently, as illustrated in FIG. 4, liquid is supplied in a pressurized manner from the liquid accommodation unit 31 to the storage chamber 41 by driving the first pressurizing unit 32 stronger than in the liquid supply process in a state in which the opening-closing valve 45 is set to the closed state. Then, a pressure in the storage chamber 41 becomes high, and the gas permeable unit 43 is displaced in a direction in which the volume of the storage chamber 41 is increased.

In the state, since pressure in the pressurized storage chamber 41 becomes higher than the pressure in the pressurizing chamber 42 which is open to the atmosphere, bubbles bu which stay at a position coming into contact with the gas permeable unit 43 are discharged to the pressurizing chamber 42 from the storage chamber 41 by penetrating the gas permeable unit 43. That is, the bubbles bu which stay in the storage chamber 41 are de-gassed from the storage chamber 41 through the gas permeable unit 43. In this point, according to the embodiment, the first pressurizing unit 32 corresponds to an example of the "pressurizing unit".

In the bubble discharging process, the pressure in the supply chamber 62 which communicates with the storage chamber 41 also becomes high when the pressure in the storage chamber 41 becomes high. However, due to this, since there is no case in which the pressure in the pressure chamber 61 becomes less than the reference pressure, the supply chamber 62 and the pressure chamber 61 do not communicate through the communication flow path 67.

The first pressurizing unit 32 is driven at the same level as that in the liquid supply process, the process proceeds to the liquid supply process, and discharging of bubbles bu is completed.

According to the embodiment, it is possible to obtain the following effects.

(1) A liquid discharging process for discharging (de-gassing) bubbles bu through the gas permeable unit 43 from the storage chamber 41 by pressurizing the storage chamber 41 is performed, after a bubble introducing process for introducing bubbles bu which float to the vertically higher part of the pressure chamber 61 to the storage chamber 41. In this manner, it is possible to discharge bubbles bu from the pressure adjusting unit 60 and not through the liquid ejecting unit 20.

(2) Since the storage chamber 41 is pressurized using the first pressurizing unit 32 which supplies liquid from the liquid accommodation unit 31 to the liquid ejecting unit 20, it is not necessary to provide a separate configuration for pressurizing the storage chamber 41. Accordingly, it is possible to simplify the configuration of the liquid ejecting apparatus 10.

(3) When liquid is supplied to the pressure chamber 61 from the liquid accommodation unit 31 and not through the storage chamber 41, there is a concern that liquid which flows into the storage chamber 41 may deteriorate, or the like, by staying in the storage chamber 41. In contrast to this, according to the embodiment, since liquid accommodated in the liquid accommodation unit 31 is supplied to the pressure chamber 61 through the storage chamber 41, it is possible to prevent liquid from staying or deteriorating in the storage chamber 41.

(4) An open state and a closed state of the opening-closing valve 45 can be switched according to the displacement magnitude of the gas permeable unit 43 which partitions the storage chamber 41 and the pressurizing chamber 42, and the displacement magnitude of the gas permeable unit 43 can be changed according to a pressurization form of the pressurizing chamber 42 using the second pressurizing unit 49. For this reason, it is possible to easily switch the state of the opening-closing valve 45 according to driving of the second pressurizing unit 49.

(5) Since the gas permeable unit 43 is provided at the vertically higher part of the storage chamber 41, bubbles bu which flow into the storage chamber 41 float to a position which is in contact with the gas permeable unit 43. For this reason, it is possible to easily discharge bubbles bu through the gas permeable unit 43 when pressurizing the storage chamber 41.

(6) Since the introducing port 53 through which the sealing member 56 of the opening-closing valve 45 communicates with the connection flow path 84 is open or closed from the storage chamber 41 side, it is possible to switch the opening-closing valve 45 to an open state in a state in which bubbles bu float to the vicinity of the storage chamber 41, compared to a case in which the outlet 69 through which the connection flow path 84 and the pressure chamber 61 communicate is open or closed from the pressure chamber 61 side. Accordingly, it is possible to easily introduce bubbles bu which float to the vicinity of the storage chamber 41 to the storage chamber 41 when the opening-closing valve 45 is set to an open state.

(7) Since the pressure chamber 61 is provided at the vertically higher part of the liquid ejecting unit 20, in the liquid supply process, even when bubbles bu flow into the liquid ejecting unit 20 or the third supply flow path 83, it is possible to cause the bubbles bu to float to the pressure chamber 61. In addition, it is possible to cause the bubbles bu which float to the pressure chamber 61 to float to the introducing port 53 of the bubble discharging unit 40 through the connection flow path 84.

(8) Since the storage chamber 41 is provided at the vertically higher part of the supply chamber 62, and the second supply flow path 82 which connects the supply chamber 62 and the storage chamber 41 is connected to the inflow port 66 which is provided at the vertically higher part of the supply chamber 62, even when bubbles bu flow into the supply chamber 62 or the second supply flow path 82 in the liquid supply process, it is possible to cause the bubbles bu to float to the storage chamber 41.

(9) In the bubble introducing process, when the opening-closing valve 45 is switched from a closed state to an open state, capping is performed with respect to the liquid ejecting unit 20. By doing so, since a closed space CS including an opening of the nozzle 21 of the liquid ejecting unit 20 is formed, a pressure in the closed space CS becomes gradually high along with an increase in the outflow amount of liquid from the nozzle 21 of the liquid ejecting unit 20, and liquid hardly flows out from the nozzle 21 of the liquid ejecting unit 20. That is, it is possible to reduce an amount of consumption of liquid in the bubble introducing process.

(10) In the bubble introducing process, a pressurizing supply of liquid using the first pressurizing unit 32 is stopped before switching the opening-closing valve 45 from a closed state to an open state. By doing so, quantity of flow of liquid which flows from the storage chamber 41 to the pressure chamber 61 becomes gradually small when a pressure difference between the storage chamber 41 and the pressure chamber 61 becomes gradually small along with an elapse of time after the opening-closing valve 45 is switched to an open state. Accordingly, it is possible to reduce a consumption amount of liquid in the bubble introducing process compared to a case in which the first pressurizing unit 32 is continuously driven.

The embodiment may be changed as follows.

Figure 5:
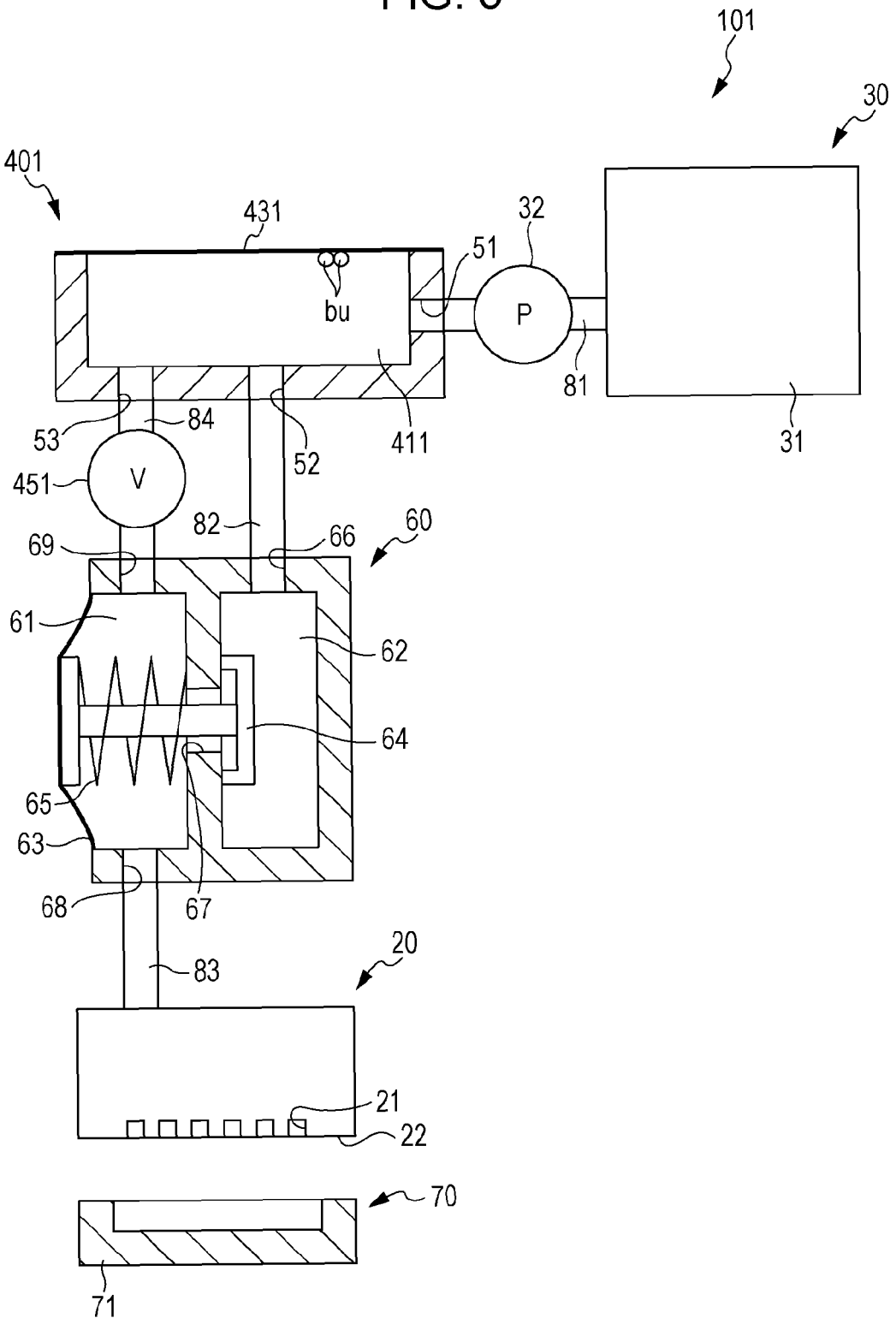
FIG. 5 is a diagram which illustrates a schematic configuration of a liquid ejecting apparatus in a modification example.

The liquid ejecting apparatus 10 according to the embodiment may be a liquid ejecting apparatus 101 as illustrated in FIG. 5.

That is, as illustrated in FIG. 5, a bubble discharging unit 401 of the liquid ejecting apparatus 101 may include a storage chamber 411 which is formed by a gas permeable unit 431 which partitions a storage chamber 411 and an external space (atmosphere). In this case, an opening-closing valve 451 which switches from an open state in which a pressure chamber 61 and the storage chamber 411 communicate to a closed state in which the pressure chamber 61 and the storage chamber 411 do not communicate may be a general sluice valve (two-way valve). As illustrated in FIG. 5, the opening-closing valve 451 may be provided in the middle of a connection flow path 84, may be provided in an outlet 69 of the pressure chamber 61, or may be provided in an introducing port 53 of the storage chamber 411.

It is possible to obtain the same effects as those in (1) to (3), (5), and (7) to (10) in the above described embodiment according to the liquid ejecting apparatus 101 which is illustrated in FIG. 5.

Figure 6A:
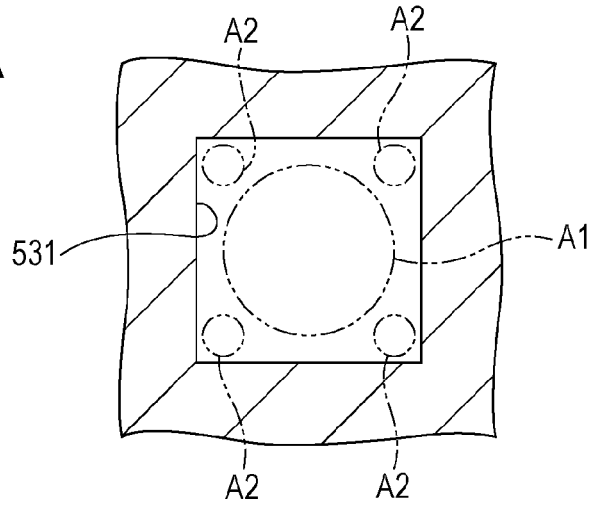
FIGS. 6A to 6C are sectional views which illustrate shapes of introducing ports of a storage chamber in modification examples.
Figure 6B:
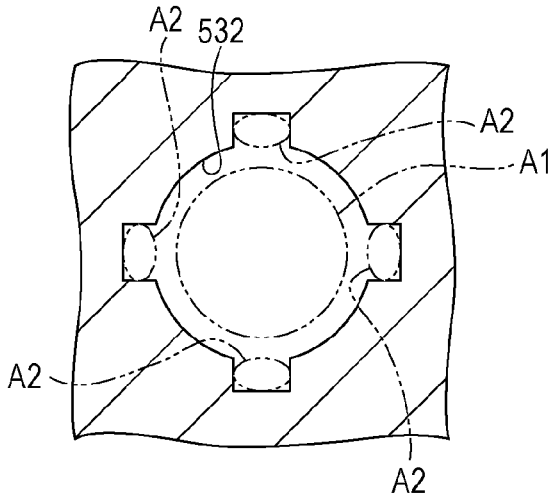
Figure 6C:
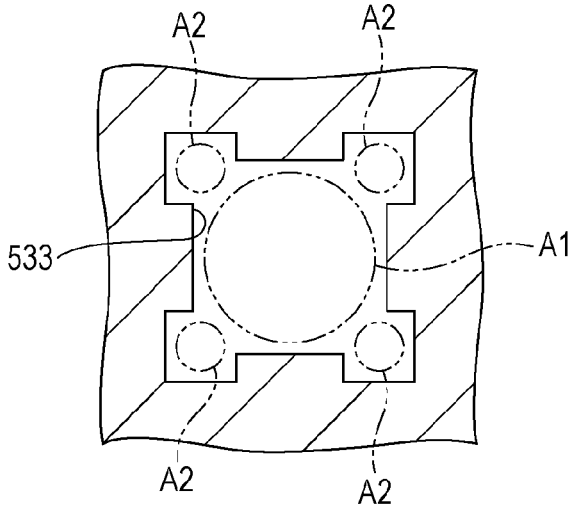

As described above, in the bubble introducing process, when the opening-closing valve 45 is switched from a closed state to an open state, even when liquid flows out from the storage chamber 41 through the introducing port 53, a sectional shape of the introducing port 53 may be a shape which is illustrated in FIGS. 6A to 6C in order to introduce bubbles bu to the storage chamber 41 through the introducing port 53. Here, FIG. 6A to 6C illustrate sectional shapes of introducing ports 531, 532, and 533 which intersect (orthogonal to) the circulation direction of liquid and bubbles bu.

For example, as illustrated in FIG. 6A, the sectional shape of the introducing port 531 may be a rectangular shape. In this case, it is possible to expect an effect that a region A1 in the vicinity of the center which is far from a flow path wall face is made so that liquid easily circulates toward the pressure chamber 61, and a region A2 in the vicinity of a corner which is close to the flow path wall face is set so that bubbles bu easily float toward the storage chamber 41.

As illustrated in FIG. 6B, the sectional shape of the introducing port 532 may be a circular shape, and a shape in which a plurality of rectangular shapes are arranged on a circumference of the circular shape. Also in this case, it is possible to expect an effect that a region A1 in the vicinity of a center which is far from a flow path wall face is made so that liquid easily circulates toward the pressure chamber 61, and a region A2 in the vicinity of a corner which is close to the flow path wall face is set so that bubbles bu easily float toward the storage chamber 41.

As illustrated in FIG. 6C, the sectional shape of the introducing port 533 may be a rectangular shape, and a shape in which a plurality of rectangular shapes are arranged at the top of the rectangular shape. Also in this case, it is possible to expect an effect that a region A1 in the vicinity of a center which is far from a flow path wall face is made so that liquid easily circulates toward the pressure chamber 61, and a region A2 in the vicinity of a corner which is close to the flow path wall face is set so that bubbles bu easily float toward the storage chamber 41.

The third supply flow path 83 and the liquid ejecting unit 20 may be provided at the vertically lower part of the pressure chamber 61. For example, the pressure chamber 61, the third supply flow path 83, and the liquid ejecting unit 20 may be arranged at the same height in the vertical direction. In this case, it is preferable that the outlet 69 which is connected to the connection flow path 84 is formed on a ceiling face arranged at the vertically uppermost part in a space including the pressure chamber 61 and the third supply flow path 83.

The downstream end of the first supply flow path 81 may be connected to the supply chamber 62. That is, liquid which is accommodated in the liquid accommodation unit 31 may be supplied to the supply chamber 62 not through the storage chamber 41 of the bubble discharging unit 40. In this case, the first pressurizing unit 32 can pressurize the storage chamber 41 which communicates with the supply chamber 62 through the second supply flow path 82 by pressurizing the supply chamber 62.

Pressurizing cleaning for causing liquid to flow out from the nozzle 21 of the liquid ejecting unit 20 may be performed by causing paths from the liquid accommodation unit 31 to the liquid ejecting unit 20 to communicate in a state in which the first pressurizing unit 32 is driven, in order to maintain favorable liquid ejecting properties in the nozzle 21 of the liquid ejecting unit 20. Here, the bubble introducing process according to the embodiment may be performed in conjunction with the above described pressurizing cleaning. By doing so, the bubble introducing process also functions as pressurizing cleaning, and in the bubble introducing process, it is possible to effectively use liquid which flows out from the liquid ejecting unit 20.

The opening-closing valve 45 may be provided in the pressure chamber 61. In this case, the sealing member 56 of the opening-closing valve 45 opens or closes the outlet 69 of the pressure chamber 61 from the pressure chamber 61 side.

The bubble discharging process may not be performed. Also in this case, in the liquid supply process, since the pressure in the storage chamber 41 becomes higher than that of the pressurizing chamber 42 which is partitioned through the gas permeable unit 43, it is possible to discharge (de-gas) bubbles bu which stay in the storage chamber 41 through the gas permeable unit 43.

In the liquid supply process and the bubble discharging process, the supply pressure of the liquid may be the same.

When the liquid ejecting apparatus 10 is first used, initial filling for filling the bubble discharging unit 40 which is not filled with liquid is performed, the pressure adjusting unit 60, the liquid ejecting unit 20, the first supply flow path 81, the second supply flow path 82, the third supply flow path 83, and the connection flow path 84 which are accommodated in the liquid accommodation unit 31 are filled with liquid. Therefore, in the above described embodiment, the initial filling may be performed by sending liquid accommodated in the liquid accommodation unit 31 to the downstream side in a pressurized manner by driving the first pressurizing unit 32. In this case, air included in the bubble discharging unit 40 which is not filled with liquid or the first supply flow path 81 is discharged from the storage chamber 41 to the pressurizing chamber 42 through the gas permeable unit 43. When the initial filling is performed, it is preferable that the valve 64 is operated through the flexible unit 63 so that the valve 64 of the pressure adjusting unit 60 is arranged at a position in which the valve opens the communication flow path 67.

The pressurizing chamber 42 may be filled with liquid. In this case, it is preferable that the liquid which fills the pressurizing chamber 42 is liquid in which bubbles bu (air) are easily dissolved compared to liquid accommodated in the liquid accommodation unit 31.

A flow path sectional area of the introducing port 53 of the storage chamber 41 may be set so as to be small toward the storage chamber 41 side. By doing so, it is possible to make bubbles bu easily stay at the vertically higher part of the introducing port 53.

The gas permeable unit 43 may be formed of a rubber material other than silicone rubber, or a resin material. For example, the gas permeable unit may be a gas separation membrane in which amorphous fluoric resin coating is formed on a single face side of a support layer which is formed of a porous polytetra fluoroethylene resin, or a porous polyolefin resin.

The gas permeable unit 43 may be formed of a material with elasticity which is not deformed according to a pressure change in the storage chamber 41.

The gas permeable unit 43 may be displaced in a direction in which the volume of the storage chamber 41 is reduced by pressing the gas permeable unit 43 using a cam member which is connected to a motor so as to be driven without providing the pressurizing chamber 42. In this case, the cam member and the motor correspond to an example of the "external force applying unit".

A filter which captures bubbles may be provided between the liquid supply unit 30 and the liquid ejecting unit 20. For example, such a filter may be provided in the inflow port 51 of the storage chamber 41, the outflow port 52 of the storage chamber 41, and the outflow port 68 of the pressure chamber 61.

The pressure in the pressure chamber 61 when the valve 64 is switched from a state in which an opening of the communication flow path 67 is closed to a state in which the opening is open may be changed by providing a space in which an external pressure in the pressure chamber 61 can be changed, and by changing the pressure of the space. By doing so, by changing the pressure of the external space of the pressure chamber 61 to a pressure which is higher than atmospheric pressure, the pressure chamber 61 and the supply chamber 62 are caused to communicate when the valve 64 opens the opening of the communication flow path 67, and it is possible to set the pressure in the pressure chamber 61 (reference pressure) to a pressure higher than atmospheric pressure (positive pressure).

The bubble discharging unit 40 and the pressure adjusting unit 60 may be integrally formed in the liquid ejecting unit 20.

A gas permeable unit for discharging air included in a liquid ejecting unit 20, or the like, which is not filled with liquid may be separately provided in the liquid ejecting unit 20, when initial filling is performed.

The liquid ejecting apparatus 10 may be a serial printer in which the liquid ejecting unit 20 ejects ink while reciprocating in a width direction of a medium M, and may be a line printer in which the liquid ejecting unit 20 ejects ink in a state of being arranged in a fixed manner with a length corresponding to the entire width of the medium M.

Liquid which is ejected by the liquid ejecting unit 20 is not limited to ink, and may be a liquid body, or the like, which is obtained by dispersing or mixing particles of a functional material into liquid, for example. For example, it may be a configuration in which recording is performed by ejecting a liquid body including a material such as an electrode material which is used when manufacturing, for example, a liquid crystal display, an electroluminescence (EL) display, and a surface light emission display, or a coloring material (pixel material) in a form of dispersing or dissolving.

The medium M is not limited to a sheet, may be a plastic film, a thin plate, or the like, and may be cloth which is used in a textile printing apparatus, or the like.

The entire disclosure of Japanese Patent Application No. 2014-236784, filed Nov. 21, 2014 is expressly incorporated by reference herein.

What is claimed is:

1. A liquid ejecting apparatus comprising:

a liquid ejecting unit which can eject liquid from a nozzle;

a supply flow path through which liquid is supplied to the nozzle;

a pressure adjusting unit which includes a pressure chamber which can store liquid provided in the middle of the supply flow path, allows a supply of liquid to the nozzle side when the pressure in the pressure chamber is less than a reference pressure which is smaller than an external pressure in the pressure chamber, and regulates a supply of liquid to the nozzle side when the pressure in the pressure chamber is equal to or greater than the reference pressure;

a storage chamber at least a part of which is formed by a gas permeable unit, and which stores liquid;

a connection flow path which connects a space and the storage chamber, the space including a flow path portion from the pressure chamber to the nozzle in the supply flow path and the pressure chamber;

an opening-closing valve which can be switched from an open state in which the space and the storage chamber are set to a communicating state through the connection flow path to a closed state in which the space and the storage chamber are set to a non-communicating state through the connection flow path; and a pressurizing unit which pressurizes the storage chamber when the opening-closing valve is in the closed state, wherein the pressure adjusting unit is downstream in a liquid flow direction of the storage chamber and open-closing valve.

2. The liquid ejecting apparatus according to claim 1, wherein the pressurizing unit is a pressurizing supply unit which supplies liquid accommodated in a liquid accommodation unit toward the liquid ejecting unit in a pressurized manner.

3. The liquid ejecting apparatus according to claim 1, wherein the supply flow path supplies liquid to the pressure chamber through the storage chamber.

4. The liquid ejecting apparatus according to claim 1, wherein the gas permeable unit is provided at a vertically higher part of the storage chamber.

5. The liquid ejecting apparatus according to claim 1, wherein the opening-closing valve includes a sealing member which is provided in the storage chamber, and can open or close an introducing port which causes the connection flow path and the storage chamber to communicate, and wherein the opening-closing valve is set to the closed state when the sealing member closes the introducing port, and is set to the open state when the sealing member opens the introducing port.

6. The liquid ejecting apparatus according to claim 1, wherein the connection flow path connects the space including the flow path portion from the pressure chamber to the nozzle and the pressure chamber, and the storage chamber.

7. The liquid ejecting apparatus according to claim 1, further comprising:

an external force applying unit which applies external force to the gas permeable unit, wherein the gas permeable unit is flexible, and wherein the external force applying unit switches the opening-closing valve from the closed state to the open state by causing the gas permeable unit to be displaced in a direction in which the volume of the storage chamber is reduced.

8. The liquid ejecting apparatus according to claim 7, further comprising:

a pressurizing chamber which is partitioned from the storage chamber through the gas permeable unit, wherein the external force applying unit applies an external force to the gas permeable unit by pressurizing the pressurizing chamber.

9. The liquid ejecting apparatus according to claim 1, wherein, when the opening-closing valve is in the closed state, the opening-closing valve is set to the open state before pressurizing the storage chamber.

10. The liquid ejecting apparatus according to claim 9, wherein the liquid ejecting unit is capped before setting the opening-closing valve to the open state.

* * * * *